US010428783B2

(12) United States Patent
Ferraris et al.

(10) Patent No.: US 10,428,783 B2
(45) Date of Patent: Oct. 1, 2019

(54) COOLING SYSTEM FOR AN INTERNAL COMBUSTION ENGINE OF A MOTOR-VEHICLE

(71) Applicant: C.R.F. Società Consortile per Azioni, Orbassano (Turin) (IT)

(72) Inventors: Walter Ferraris, Orbassano (IT); Federica Bettoja, Orbassano (IT); Fausto Di Sciullo, Orbassano (IT)

(73) Assignee: C.R.F. Societa Consortile per Azioni, Orbassano (Torino) (IT)

( * ) Notice: Subject to any disclaimer, the term of this patent is extended or adjusted under 35 U.S.C. 154(b) by 0 days.

(21) Appl. No.: 15/898,794

(22) Filed: Feb. 19, 2018

(65) Prior Publication Data

US 2018/0252196 A1 Sep. 6, 2018

(30) Foreign Application Priority Data

Mar. 3, 2017 (EP) ..... 17159237

(51) Int. Cl.
*F01P 9/00* (2006.01)
*F02N 19/10* (2010.01)
(Continued)

(52) U.S. Cl.
CPC ..... *F02N 19/10* (2013.01); *F01P 5/12* (2013.01); *F01P 7/16* (2013.01); *F01P 7/165* (2013.01);
(Continued)

(58) Field of Classification Search
CPC ..... F01P 2011/205; F02N 11/0829; F28D 20/0034; B60H 1/00492
(Continued)

(56) References Cited

U.S. PATENT DOCUMENTS 2,401,510 A 6/1946 Albert
5,299,630 A 4/1994 Schatz
(Continued)

FOREIGN PATENT DOCUMENTS

DE 1626571 A1 11/1969
DE 102013222557 A1 5/2015
(Continued)

OTHER PUBLICATIONS

European Search Report for EP Application No. 17159237.1 dated Sep. 15, 2017, 3 pages.

*Primary Examiner* — Marguerite J McMahon
*Assistant Examiner* — James J Kim
(74) *Attorney, Agent, or Firm* — RMCK Law Group PLC

(57) ABSTRACT

A cooling system for an internal combustion engine of a motor-vehicle presenting a circuit for a coolant of the engine. The circuit includes a thermally insulated tank for the coolant of the engine, connected to an outer portion of the cooling circuit. The tank is arranged in the circuit to retain a defined quantity of coolant at a temperature above the ambient temperature when the engine is inactive, and for causing this quantity of coolant to flow, at a temperature above the ambient temperature, into the cooling circuit of the engine, after a subsequent start of the engine, during an engine warm up stage. The circuit also includes an expansion vessel connected to the outer circuit portion of the coolant of the engine. The expansion vessel has a thermally insulated body and constitutes the thermally insulated tank for the engine coolant.

8 Claims, 3 Drawing Sheets

Figure 1:
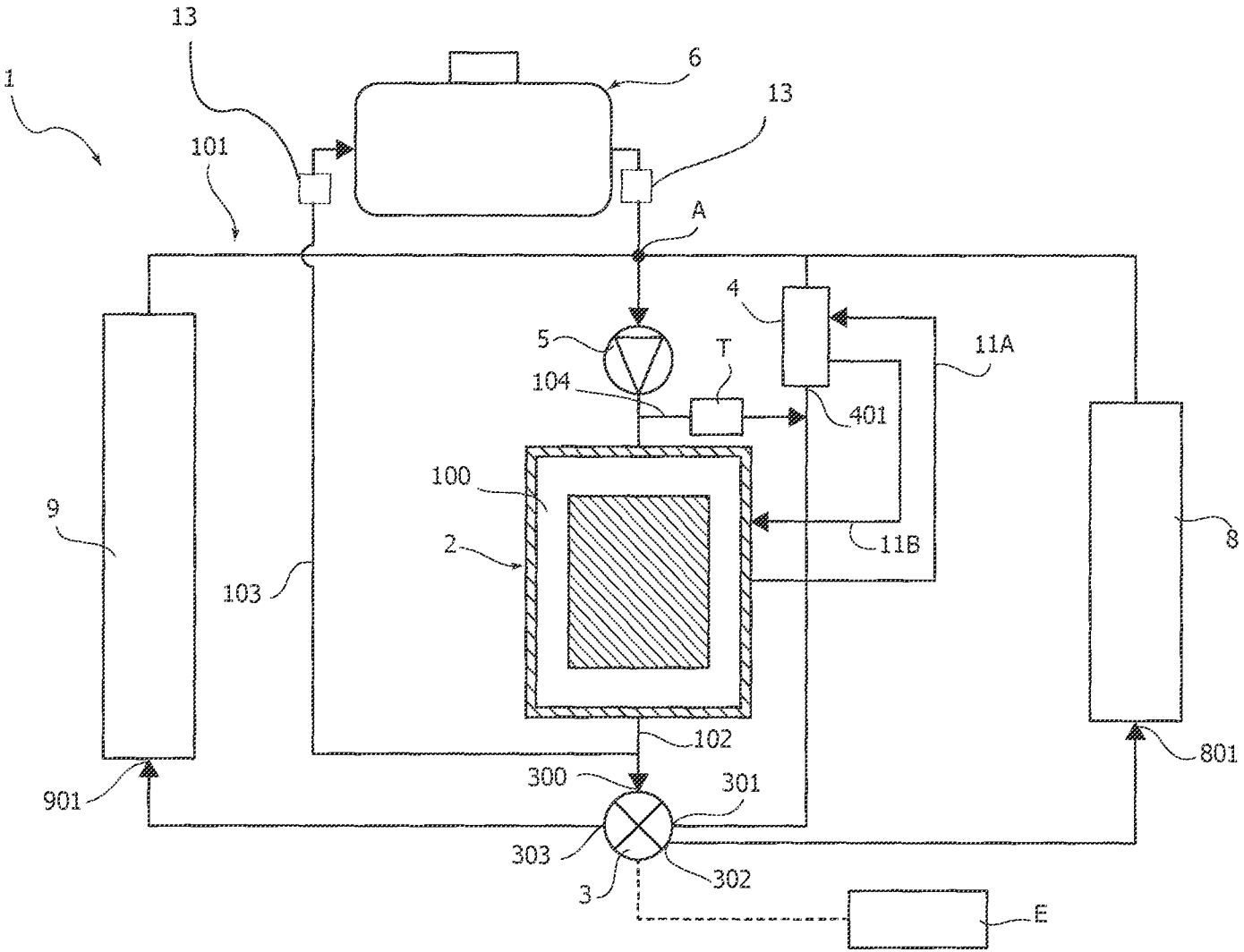

(51) Int. Cl.

| | |
|---|---|
| ***F01P 7/16*** | (2006.01) |
| ***F01P 11/02*** | (2006.01) |
| ***F01P 5/12*** | (2006.01) |
| ***F01P 11/16*** | (2006.01) |
| *F01P 11/20* | (2006.01) |
| *F01P 7/14* | (2006.01) |

(52) U.S. Cl.
CPC ..... *F01P 11/029* (2013.01); *F01P 11/16* (2013.01); *F01P 2007/146* (2013.01); *F01P 2011/205* (2013.01); *F01P 2023/00* (2013.01); *F01P 2060/04* (2013.01); *F01P 2060/08* (2013.01)

(58) Field of Classification Search
USPC ..... 123/41.14, 41.01
See application file for complete search history.

(56) References Cited

U.S. PATENT DOCUMENTS

| | | | | |
|---|---|---|---|---|
| 5,662,072 | A * | 9/1997 | Suzuki | F01P 11/029 123/142.5 R |
| 6,742,480 | B2 * | 6/2004 | Onimaru | B60H 1/00492 123/41.01 |
| 6,892,681 | B2 * | 5/2005 | Morikawa | F01P 11/20 123/41.14 |
| 6,990,931 | B2 * | 1/2006 | Ito | B60H 1/00492 123/41.14 |
| 6,994,058 | B2 * | 2/2006 | Iinuma | F01P 11/0276 123/41.14 |
| 9,435,248 | B2 * | 9/2016 | Park | F01P 7/14 |
| 10,036,302 | B2 * | 7/2018 | Watanabe | F02D 41/04 |
| 2005/0034688 | A1 * | 2/2005 | Lelkes | F01P 7/167 123/41.01 |
| 2005/0229873 | A1 * | 10/2005 | Willers | F01P 11/20 123/41.14 |
| 2009/0288617 | A1 * | 11/2009 | Hiyama | B60H 1/14 123/41.14 |

FOREIGN PATENT DOCUMENTS

| | | | |
|---|---|---|---|
| EP | 3246541 | A1 | 11/2017 |
| FR | 2679603 | A1 | 1/1993 |
| FR | 2693763 | A1 | 1/1994 |
| JP | H08232659 | A | 9/1996 |
| JP | H1071839 | A | 3/1998 |
| JP | H10309933 | A | 11/1998 |
| JP | 2002266679 | A | 9/2002 |
| JP | 2003322019 | A | 11/2003 |
| JP | 2008082225 | A | 4/2008 |
| JP | 2010112236 | A | 5/2010 |
| WO | 0244074 | A2 | 6/2002 |
| WO | 2015114225 | A1 | 8/2015 |

* cited by examiner

COOLING SYSTEM FOR AN INTERNAL COMBUSTION ENGINE OF A MOTOR-VEHICLE

CROSS REFERENCE TO RELATED APPLICATIONS

This application claims priority to European Patent Application No. 1715237.1 filed on Mar. 3, 2017, the entire disclosure or which is incorporated herein by reference.

FIELD OF THE INVENTION

The present invention relates to cooling systems for internal combustion engines of motor-vehicles, of the type comprising:

- a circuit for a coolant of the engine, including an inner circuit portion internal to the engine and an outer circuit portion external to the engine,
- a thermally insulated tank for the coolant of the engine, connected to said outer portion of the cooling circuit, adapted for retaining a defined quantity of coolant at a temperature above the ambient temperature when the engine is inactive, and provided for causing flowing of this quantity of coolant, at a temperature above the ambient temperature, into the cooling circuit of the engine, after a subsequent start of the engine, during an engine warm up stage,
- an expansion vessel connected to said outer portion of the coolant circuit of the engine,
- wherein said expansion vessel has a thermally insulated body and constitutes said thermally insulated tank for the coolant of the engine.

PRIOR ART

In cooling systems of the type indicated above, the aforesaid thermally insulated tank is used to accelerate the engine heating stage after its cold start, thanks to the possibility of using the relatively warm liquid stored in it. Systems of this type are known, for example, in documents US 2005229873, U.S. Pat. Nos. 5,299,630, 2,401,510, JP3353236, JP5189461, JP2002266679, JP2003322019, JPH10309933, JP3843499 and JP2008082225.

In the European patent application EP16169784.2, which forms part of the state of the art pursuant to the Art. 54 (3)EPC, the Applicant proposed a system for heat recovery in a cooling circuit of an internal combustion engine having a thermally insulated tank for the coolant of the engine and an expansion vessel both connected to the outer circuit portion external to the engine.

Moreover, the international patent application WO2015/114225 A1 shows an expansion vessel having a thermally insulated body.

OBJECT OF THE INVENTION

The object of the present invention is that of providing a cooling system of the type described above in which the heating stage after a cold start of the engine is accelerated and in which an operative condition of the engine is also achieved in the shortest possible time to allow the minimum fuel consumption. A further object of the present invention is to provide these functions with a cooling system that presents a significant reduction of production costs and a greater integration compared to systems belonging to the prior art.

SUMMARY OF THE INVENTION

In view of achieving the above objects, the present invention relates to a cooling system for an internal combustion engine of a motor-vehicle having all the characteristics indicated at the beginning of the present description and also characterized in that:

- said outer portion of the circuit of the coolant of the engine also comprises a pump for actuating circulation of the coolant in the circuit, a cooler for the lubrication oil of the engine, a heater for the passenger compartment of the motor-vehicle, a radiator for cooling the coolant, an electronically-controlled distribution valve for controlling the flow of the coolant in the circuit,
- wherein said electronically-controlled distribution valve has an inlet connected to a first duct, which feeds the coolant leaving the engine, a first outlet connected to an inlet of the lubrication oil cooler of the engine, a second outlet connected to an inlet of said passenger compartment heater, and a third outlet connected to an inlet of said radiator,
- an electronic control unit for controlling the operating condition of said electronically-controlled distribution valve as a function of one or more operating parameters, including at least one detected value of the temperature of the coolant,
- wherein said expansion vessel is interposed in a second duct, which connects said first duct to an inlet for the coolant in said internal combustion engine, said pump being interposed in a terminal portion of said second duct downstream of said expansion vessel and said expansion vessel being in a higher position compared to said pump,
- wherein said electronically-controlled distribution valve is selectively switchable between one of the following operating conditions:
- a closed condition, wherein all the aforesaid first, second and third outlets are isolated with respect to said inlet of the valve,
- a first open condition, wherein only said first outlet communicates with the inlet 300 of the valve,
- a second open condition, wherein only the first and second outlets communicate with the inlet of the valve, and
- a third open condition, wherein all the said first, second and third outlets communicate with said inlet of the valve.

Thanks to these characteristics, the system according to the invention performs the functions for which it is designed in an effective manner, at the same time resulting as being economic to produce, also thanks to the low number of components used.

According to a further characteristic of the invention, the electronic control unit is programmed in such a way that after starting the internal combustion engine, the following operative steps are implemented in succession, with increase of said detected value of the temperature of the engine coolant:

- a first step wherein the electronically-controlled distribution valve is maintained in its first open condition, so that the coolant leaving the engine is fed to the lubrication oil cooler of the engine,
- a second step wherein the electronically-controlled distribution valve is maintained in its second open condition, so that the coolant leaving the engine is fed both to the lubrication oil cooler of the engine, and to the passenger compartment heater, and a third step wherein the electronically-controlled distribution valve is maintained in its third open condition, so that the coolant leaving the engine is fed to the lubrication oil cooler of the engine, and to the passenger compartment heater, and to the radiator.

According to an embodiment of the invention, the system comprises also a thermostat, which is interposed in a third conduit which connects said second conduit in a point downstream of said pump with said inlet of the cooler.

In this embodiment with the thermostat, the electronic control unit is programmed in such a way that after starting the internal combustion engine and before said first step wherein the electronically-controlled distribution valve is maintained in its first open condition, there is an operative preliminary step wherein the electronically-controlled distribution valve is maintained in said closed condition, wherein the thermostat is in an open condition, so that the coolant leaving the engine flows through said first duct, through said second duct, through said expansion vessel and through said third duct, causing feeding to the lubrication oil cooler of the engine of the liquid in the quantity previously stored in the expansion vessel. During said first, second and third step the thermostat is in a closed condition.

Other special features of alternative embodiments of the invention are indicated in the attached claims.

DESCRIPTION OF MORE EMBODIMENTS

Figure 2:
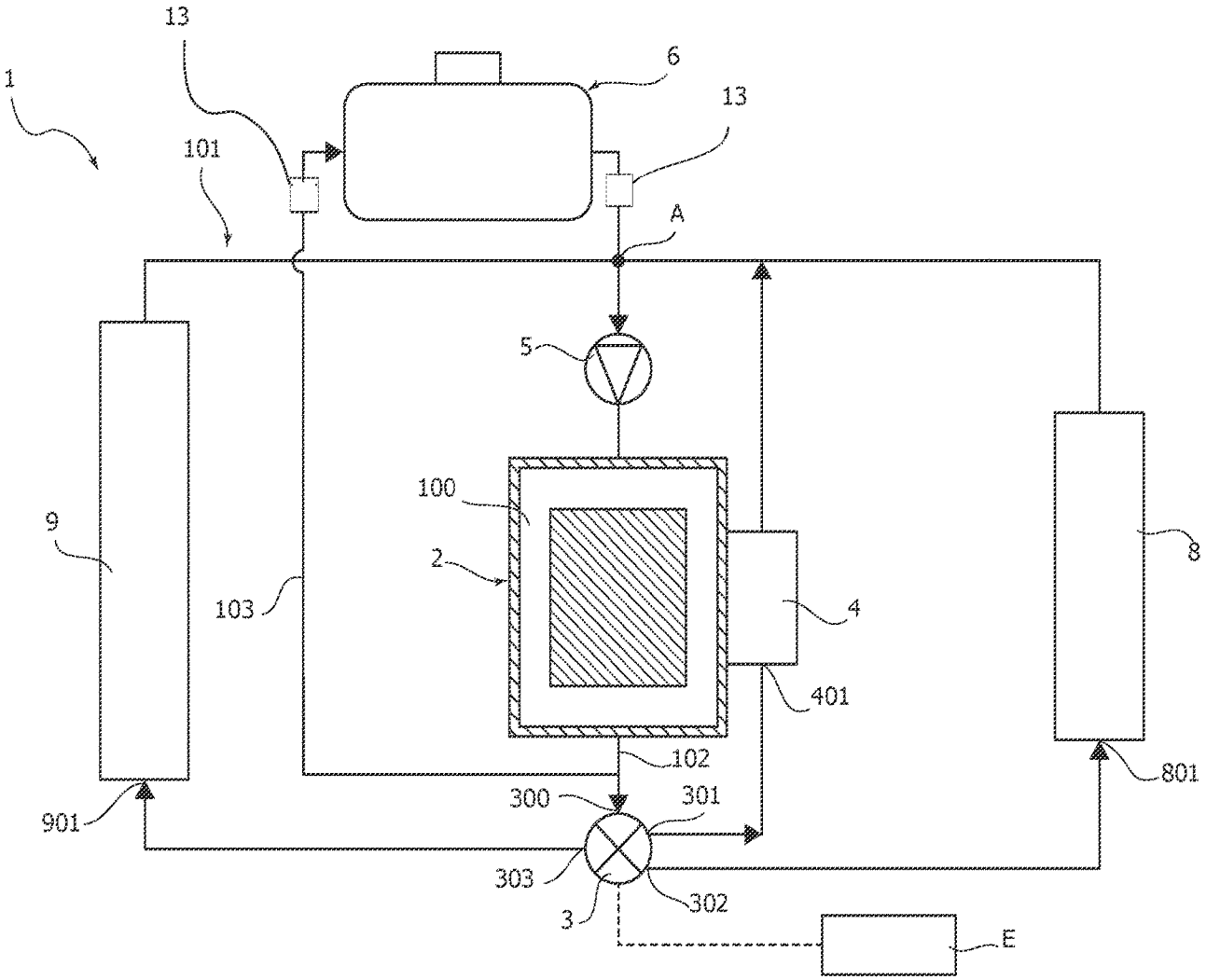
Figure 3:
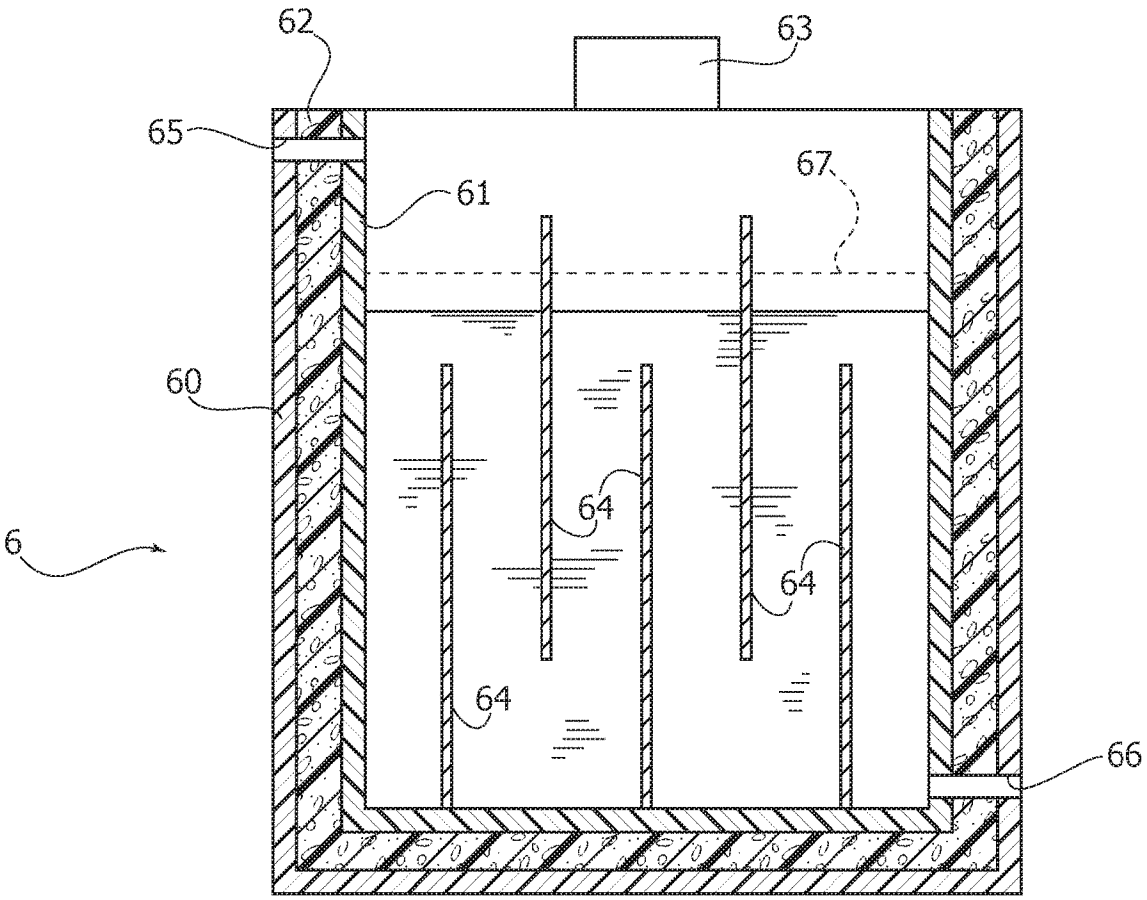

Further characteristics and advantages of the invention will become apparent from the description that follows with reference to the attached drawings, provided purely by way of non-limiting example, wherein:

FIG. 1 is a diagram of a first embodiment of the cooling system according to the invention, FIG. 2 is a diagram of a second embodiment of the cooling system according to the invention, and FIG. 3 is a schematic cross-sectional view of an expansion vessel of the system according to the invention.

With reference to the attached drawings, the reference number 1 indicates—in its entirety—a cooling system according to the present invention for an internal combustion engine 2 of a motor-vehicle.

The cooling system 1 comprises a circuit for a coolant of the engine 2, including an inner circuit portion 100 of the engine 2, and an outer circuit portion 101 of the engine.

The outer circuit portion 101 of the engine 2 includes a first duct 102, which feeds the coolant leaving the engine 2 towards an electronically-controlled distribution valve 3 of any known type. The distribution valve 3 has an inlet 300, which receives the coolant fed from the first duct 102, and a plurality of outlets to control the feeding of the coolant to other elements of the circuit.

The cooling system 1 comprises a thermally insulated tank 6 for the coolant of the engine. The thermally insulated tank 6 is connected to the outer portion 101 of the cooling circuit and is configured to retain a determined quantity of coolant at a temperature higher than the ambient temperature when the engine 2 is inactive. The thermally insulated tank 6 is also configured to cause this quantity of coolant at temperature higher than ambient temperature, to flow into the cooling circuit of the engine 2, after a successive start of the engine 2, in the warm up stage of the engine.

In conventional cooling systems, an expansion vessel is connected to the outer portion 101 of the coolant circuit.

However, according to a solution also known, the thermally insulated tank for the coolant of the engine 2, as well as carrying out the previously indicated functions, also constitutes the expansion vessel of the cooling system 1.

In the following part of the present description, both the expansion vessel and the thermally insulated tank of the system 1 will, therefore, be indicated with the reference 6 indifferently.

With reference to FIGS. 1-2, which illustrate alternative embodiments of the invention, the expansion vessel 6 is interposed in a second duct 103, which connects the first duct 102 to an inlet for the coolant of the internal combustion engine 2.

The cooling system 1 and, in particular, the outer circuit portion 101 of the coolant of the engine 2 also comprises a pump 5 for activating the circulation of the coolant in the circuit 1, a lubrication oil cooler 4 of the engine, a passenger compartment heater 8 and a radiator 9 for cooling the coolant. The pump 5 is interposed in a terminal portion of the second duct 103 downstream of the expansion vessel 6, which is located at a higher position with respect to the pump 5. With reference A is indicated an intersection point (node) of the circuit 1.

According to a further characteristic of the invention, the cooling system 1 further comprises an electronic control unit E for controlling the operating condition of the electronically-controlled distribution valve 3, as a function of one or more operating parameters, including at least one detected value of the temperature of the coolant. The cooling system 1 provides two temperature sensors 13 in the second duct 103 arranged upstream and downstream of the tank 6, respectively. The electronic control unit E is configured to receive the outgoing signals from the temperature sensors.

According to an important characteristic of the invention, the electronic control unit E is programmed in such a way that after starting the internal combustion engine 2, with increase of the value of the temperature of the engine coolant detected by means of a sensor (not illustrated in the drawings), a succession of operative steps.

As previously said, the cooling system 1 comprises an electronically-controlled distribution valve 3 having a plurality of outlets for controlling feeding of the coolant to different parts of the circuit.

The valve 3 is a solenoid valve and the switching between the aforesaid different operating conditions is achieved by the gradual increase of the electric voltage of the solenoid power supply. With reference to FIGS. 1 and 2, the electronically-controlled distribution valve 3 comprises:

- a first outlet 301 connected to an inlet 401 of the lubrication oil cooler 4 of the engine 2,
- a second outlet 302 connected to an inlet 801 of the passenger compartment heater 8, and
- a third outlet 303 connected to an inlet 901 of the radiator 9.

With reference to FIG. 1, in the following part of the present description, a first embodiment of the invention will now be described.

The references 11A and 11B indicate two ducts in which the oil passes from the engine 2 to the cooler 4, and from the cooler 4 to the engine 2, respectively. The structural details of how the water circulates between the various elements of the system 1 will now be described in detail.

Again with reference to the embodiment illustrated in FIG. 1, the system 1 also comprises a thermostat T interposed in a third duct 104, which connects the second duct 103 at a point downstream of the pump 5 and the inlet 401 of the lubrication oil cooler 4 of the engine 2. The thermostat T can be produced in any known way.

The electronically-controlled distribution valve 3 is selectively switchable between one of the following operating conditions:

- a closed condition, in which all the aforesaid first, second and third outlets 301, 302, 303 are isolated with respect to the inlet 300 of the valve 3,
- a first open condition, in which only the first outlet 301 communicates with the inlet 300 of the valve 3,
- a second open condition, in which only the first and second outlets 301, 302 communicate with the inlet 300 of the valve 3, and
- a third open condition, in which all the said first, second and third outlets 301, 302, 303 communicate with the inlet 300 of the valve 3.

The switching between the aforesaid different operating conditions is achieved by the gradual increase of the electric voltage of the solenoid power supply. The feeding of the distribution solenoid valve 3 is controlled by the electronic control unit E, which can be the same electronic control unit that controls the operation of the engine 2.

Again with reference to the embodiment illustrated in FIG. 1, in a first step, the electronically-controlled distribution valve 3 is maintained in its closed condition, and the thermostat T in an open condition, so that the coolant leaving the engine 2 immediately after starting the engine 2 all flows through the first duct 102, through the second duct 103, through the tank 6 and through the third duct 104, causing the feeding of the quantity of previously stored liquid in the tank 6 to the lubrication oil cooler 4 of the engine. The tank 6 is able to maintain the temperature of the coolant stored in it at a value above the ambient temperature even during prolonged stops of the motor-vehicle with the engine inactive. As indicated above, when the engine is started, the coolant leaving the engine 2, still relatively cold, is all conveyed into the tank 6, which, therefore, empties the quantity of previously stored hot liquid. The hot liquid stored in the tank 6 is then fed to the heat exchanger 4, thanks to the thermostat T, which is in an open condition. In this step, the heat exchanger 4 serves as a heater of the lubrication oil and the quantity of hot liquid previously stored in the tank 6 allows acceleration of the step of warm up the engine, oil so as to reduce the time required to heat the oil to the ideal temperature to minimize the friction of the engine and consequently the fuel consumption. Further constructional details of the tank 6 will be further described in the following part of the present description.

At the end of the first operating step, the electronic control unit E is programmed to initiate a second operating step, in which the thermostat T is in the closed condition and the electronically-controlled distribution valve 3 is maintained in its first open condition, so that the coolant leaving the engine is still fed to the lubrication oil cooler 4 of the engine without passing through the third duct 104 in which the thermostat T is interposed. Therefore, the entire flow of the coolant leaving the engine, in this second operating step as well, is directed to the heat exchanger 4, which in this step acts as a heater of the lubricating oil, so as to allow the ideal operating temperature of the oil to be reached as quickly as possible. Achieving the conclusion of this second operating step can be detected based on reaching a predetermined threshold value detected by the temperature sensor.

Once the conclusion of the second operating step is detected, the electronic control unit E is programmed to start a third operating step in which the electronically-controlled distribution valve 3 is maintained in its open condition, so that the coolant leaving the engine 2 is fed both to the lubrication oil cooler 4 of the engine, and to the passenger compartment heater 8 (in the case in which there is a request by the user of the motor-vehicle). Finally, in a fourth operating step controlled by the electronic control unit E, the electronically-controlled distribution valve 3 is maintained in its third open condition, so that the coolant leaving the engine 2 is fed both to the lubrication oil cooler 4, and the passenger compartment heater 8 (provided that there is a request by the user), as well as to the radiator 9 where the liquid is cooled before returning to the engine 2 passing from the node A.

According to an important characteristic relative to alternative embodiments of the invention, the second duct 103 flowing into the tank 6 has a narrower section compared to the first duct 102 flowing into the inlet 300 of the electronically-controlled distribution valve 3. In this way, when the valve 3 is in an open condition, the coolant leaving the engine 2 tends to flow towards the outlets of the valve 3 instead of towards the tank 6.

With reference to FIG. 2, a second embodiment of the system 1 according to the present invention will now be described. Unlike the previously described embodiment, in this case, the outer circuit portion 101 comprises the first duct 102, the second duct 103, but not the third duct 104 comprising the thermostat T. The electronic control unit E is programmed in such a way that after starting the internal combustion engine 2, three steps are implemented in succession, with the increase in the detected value of the temperature of the coolant of the engine:

- a first step in which the electronically-controlled distribution valve 3 is maintained in its first open condition, so that the coolant leaving the engine is fed to the lubrication oil cooler 4 of the engine,
- a second step in which the electronically-controlled distribution valve is maintained in its second open condition, so that the coolant leaving the engine is fed both to the lubrication oil cooler of the engine, and to the passenger compartment heater 8 (provided that there is a request by the user), and
- a third step in which the electronically-controlled distribution valve 3 is maintained in its third open condition, so that the coolant leaving the engine 2 is fed to the lubrication oil cooler of the engine 4, and to the passenger compartment heater 8 and to the radiator 9. From the radiator 9 the coolant returns in the engine passing from the node A. Also in this embodiment of the system according to the invention, the switching between the aforesaid different operating conditions is achieved by the gradual increase of the electric voltage of the solenoid power supply. The feeding of the distribution solenoid valve 3 is controlled by the electronic control unit E, which can be the same electronic control unit that controls the operation of the engine 2.

The embodiment of the system 1 according to the present invention illustrated in FIG. 2 has the advantage of being able to effectively carry out all the functions for which it is designed without the arrangement of the thermostat T previously described (further reduction in costs).

In both the embodiments above described, the cooling system 1 according to the present invention allows acceleration of the warm up stage after starting the cold engine and also allows reaching an operative condition of the engine within the shortest possible time to allow the minimum fuel consumption. Moreover, the cooling system according to the invention presents a significant reduction of production costs and a greater integration compared to systems belonging to the prior art.

In both the embodiments illustrated in FIGS. 1-2, the electronic control unit E is also configured to receive a signal indicative of a turn-off order of the internal combustion engine 2 and to consequently control a switching of the electronically-controlled distribution valve 3 into its closed condition, in such a way that the hot coolant leaving the internal combustion engine 2 is conveyed into the tank 6. In addition, the electronic control unit is also configured to enable the turning-off of the engine 2 only after having detected a filling of the tank 6 with the hot coolant leaving the engine 2. The pump 5 and the aforesaid switching of the valve 3 into the closed condition to obtain a filling of the expansion vessel 6 with the hot coolant are controlled after the internal combustion engine is turned off.

Some structural details of the thermally insulated tank 6 according to the present invention will now be described.

As previously mentioned, the system 1 is characterized, in particular, in that the expansion vessel of the system 1 has a thermally insulated body and constitutes the thermally insulated tank for the coolant of the engine.

In FIG. 3 of the attached drawings, a cross-sectional view of the tank 6 in accordance with a preferred embodiment is illustrated. The expansion vessel has a containing body that has a heat insulated wall, which comprises a first outer layer 60 spaced-apart from a second inner layer 61. Between the two layers 60, 61 is a cavity that can be filled according to the requirements, with air or insulating material 62, but in order to increase the insulating properties of the body of the expansion vessel, it is preferable to put a layer of insulating material 62 in the cavity. The containing body has an inlet 65 for the coolant, which is in communication with an upstream part of the second duct 103. The inlet 65 is located in the upper part of the containing body of the tank 6.

The containing body also comprises an outlet 66, which is in communication with a downstream part of the second duct 103. The outlet 66 is located in the lower part of the containing body.

Still according to the embodiment illustrated in FIG. 3, the interior of the containing body of the tank 6 comprises a plurality of septa 64 provided to increase retainment of heat of the tank 6. The septa 64 therefore act as a mass that accumulates heat in order to keep the liquid inside the tank 6 at the highest possible temperature.

Still with reference to FIG. 3, the reference 67 indicates a dashed line configured to indicate the maximum level that the liquid inside the tank 6 can reach, and the reference 63 indicates a stopper arranged on the upper part of the containing body of the tank 6, having holes for venting any air bubbles present within the containing body.

In accordance with the prior art, the tank 6 also comprises an indicator of the liquid level present within the containing body in order to display this information to a user. This indicator is necessary since the containing body does not present a transparent wall such as, for example, in the case of a traditional expansion vessel.

Thanks to all the previously described characteristics, the system according to the present invention allows the achievement of an accelerated warm up stage after a cold start of the engine and the achievement of an operating condition of the engine in a short time, to allow the minimum fuel consumption. These characteristics are implemented with a cooling system that presents a significant reduction in production costs and greater integration than known systems.

Of course, without prejudice to the principle of the invention, the details of construction and the embodiments may vary widely with respect to those described and illustrated purely by way of example, without departing from the scope of the present invention.

What is claimed is:

1. A cooling system for an internal combustion engine of a motor-vehicle, comprising:

a cooling circuit for a coolant of the engine, including an inner circuit portion internal to the engine and an outer circuit portion external to the engine, and an expansion vessel connected to said outer circuit portion of the cooling circuit of the engine, wherein said expansion vessel has a thermally insulated containing body that constitutes a thermally insulated tank for a defined quantity of the coolant, said thermally insulated tank being connected to said outer circuit portion of the cooling circuit, adapted for retaining the defined quantity of the coolant at a temperature above an ambient temperature when the engine is inactive, and provided for causing flowing of this defined quantity of the coolant, at the temperature above the ambient temperature, into the cooling circuit of the engine, after a subsequent start of the engine, during an engine warm up stage, wherein:

said outer circuit portion also comprises a pump for actuating circulation of the coolant in the cooling circuit, a cooler for a lubrication oil of the engine, a heater for a passenger compartment of the motor-vehicle, a radiator for cooling the coolant and an electronically-controlled distribution valve for controlling flow of the coolant in the cooling circuit, said electronically-controlled distribution valve has an inlet connected to a first duct, which feeds coolant leaving the engine, a first outlet connected to an inlet of the lubrication oil cooler of the engine, a second outlet connected to an inlet of said passenger compartment heater, and a third outlet connected to an inlet of said radiator, an electronic control unit for controlling an operating condition of said electronically-controlled distribution valve as a function of one or more operating parameters, including at least one detected value of temperature of the coolant, said expansion vessel is interposed in a second duct, which connects said first duct to an inlet for the coolant into said engine, said pump being interposed in a terminal portion of said second duct downstream of said expansion vessel and said expansion vessel being in a higher position compared to said pump, said electronically-controlled distribution valve is selectively switchable between one of the following operating conditions:

a closed condition, wherein all of the first, second and third outlets are isolated with respect to said inlet of the distribution valve, a first open condition, wherein only said first outlet communicates with the inlet of the distribution valve, a second open condition, wherein only the first and second outlets communicate with the inlet of the distribution valve, and a third open condition, wherein all the said first, second and third outlets communicate with said inlet of the distribution valve, and said thermally insulated containing body includes a thermally insulated wall, comprising at least two layers spaced-apart from each other and a cavity between said layers, filled with air or an insulating material, said thermally insulated containing body having an inlet for communicating with an upstream part of said second duct located in an upper part of said containing body, and an outlet for communicating with a downstream part of said second duct located in a lower part of said thermally insulated containing body.

2. The cooling system according to claim 1, wherein said electronic control unit is programmed in such a way that after starting the engine, the following operative steps are implemented in succession, with increase of said detected value of the temperature of the coolant:

a first step wherein the electronically-controlled distribution valve is maintained in its first open condition, so that coolant leaving the engine is fed to the lubrication oil cooler of the engine, a second step wherein the electronically-controlled distribution valve is maintained in its second open condition, so that coolant leaving the engine is fed both to the lubrication oil cooler of the engine, and to the passenger compartment heater, and a third step wherein the electronically-controlled distribution valve is maintained in its third open condition, so that coolant leaving the engine is fed to the lubrication oil cooler of the engine, and to the passenger compartment heater, and to the radiator.

3. The cooling system according to claim 2, wherein:

said electronic control unit is programmed in such a way that after starting the engine and before said first step wherein the electronically-controlled distribution valve is maintained in its first open condition, there is an operative preliminary step wherein:

the electronically-controlled distribution valve is maintained in said closed condition, a thermostat, which is interposed in a third duct which connects said second duct in a point downstream of said pump with said inlet of the lubrication oil cooler, is in an open condition, so that the coolant leaving the engine flows through said first duct, through said second duct, through said expansion vessel and through said third duct, causing feeding to the lubrication oil cooler of the engine of the coolant in the defined quantity previously stored in the expansion vessel, in said first, second and third steps, the thermostat is in a closed condition.

4. The cooling system according to claim 1, wherein one or more septa are arranged within said containing body, which act as heat storage elements.

5. A cooling system for an internal combustion engine of a motor-vehicle, comprising:

a cooling circuit for a coolant of the engine, including an inner circuit portion internal to the engine and an outer circuit portion external to the engine, and an expansion vessel connected to said outer circuit portion of the cooling circuit of the engine, wherein said expansion vessel has a thermally insulated containing body that constitutes a thermally insulated tank for a defined quantity of the coolant, said thermally insulated tank being connected to said outer circuit portion of the cooling circuit, adapted for retaining the defined quantity of the coolant at a temperature above an ambient temperature when the engine is inactive, and provided for causing flowing of this defined quantity of the coolant, at the temperature above the ambient temperature, into the cooling circuit of the engine, after a subsequent start of the engine, during an engine warm up stage, wherein:

said outer circuit portion also comprises a pump for actuating circulation of the coolant in the cooling circuit, a cooler for a lubrication oil of the engine, a heater for a passenger compartment of the motor-vehicle, a radiator for cooling the coolant and an electronically-controlled distribution valve for controlling flow of the coolant in the cooling circuit, said electronically-controlled distribution valve has an inlet connected to a first duct, which feeds coolant leaving the engine, a first outlet connected to an inlet of the lubrication oil cooler of the engine, a second outlet connected to an inlet of said passenger compartment heater, and a third outlet connected to an inlet of said radiator, an electronic control unit for controlling an operating condition of said electronically-controlled distribution valve as a function of one or more operating parameters, including at least one detected value of temperature of the coolant, said expansion vessel is interposed in a second duct, which connects said first duct to an inlet for the coolant into said engine, said pump being interposed in a terminal portion of said second duct downstream of said expansion vessel and said expansion vessel being in a higher position compared to said pump, said electronically-controlled distribution valve is selectively switchable between one of the following operating conditions:

a closed condition, wherein all of the first, second and third outlets are isolated with respect to said inlet of the distribution valve, a first open condition, wherein only said first outlet communicates with the inlet of the distribution valve, a second open condition, wherein only the first and second outlets communicate with the inlet of the distribution valve, and a third open condition, wherein all the said first, second and third outlets communicate with said inlet of the distribution valve, and said second duct flowing into the expansion vessel has a narrower section with respect to said first duct flowing into the inlet of said electronically-controlled distribution valve, in such a way that when the distribution valve is in an open condition, the coolant leaving the engine tends to flow towards the outlets of the distribution valve instead of towards said expansion vessel.

6. A cooling system for an internal combustion engine of a motor-vehicle, comprising:

a cooling circuit for a coolant of the engine, including an inner circuit portion internal to the engine and an outer circuit portion external to the engine, and an expansion vessel connected to said outer circuit portion of the cooling circuit of the engine, wherein said expansion vessel has a thermally insulated containing body that constitutes a thermally insulated tank for a defined quantity of the coolant, said thermally insulated tank being connected to said outer circuit portion of the cooling circuit, adapted for retaining the defined quantity of the coolant at a temperature above an ambient temperature when the engine is inactive, and provided for causing flowing of this defined quantity of the coolant, at the temperature above the ambient temperature, into the cooling circuit of the engine, after a subsequent start of the engine, during an engine warm up stage, wherein:

said outer circuit portion also comprises a pump for actuating circulation of the coolant in the cooling circuit, a cooler for a lubrication oil of the engine, a heater for a passenger compartment of the motor-vehicle, a radiator for cooling the coolant and an electronically-controlled distribution valve for controlling flow of the coolant in the cooling circuit, said electronically-controlled distribution valve has an inlet connected to a first duct, which feeds coolant leaving the engine, a first outlet connected to an inlet of the lubrication oil cooler of the engine, a second outlet connected to an inlet of said passenger compartment heater, and a third outlet connected to an inlet of said radiator, an electronic control unit for controlling an operating condition of said electronically-controlled distribution valve as a function of one or more operating parameters, including at least one detected value of temperature of the coolant, said expansion vessel is interposed in a second duct, which connects said first duct to an inlet for the coolant into said engine, said pump being interposed in a terminal portion of said second duct downstream of said expansion vessel and said expansion vessel being in a higher position compared to said pump, said electronically-controlled distribution valve is selectively switchable between one of the following operating conditions:

a closed condition, wherein all of the first, second and third outlets are isolated with respect to said inlet of the distribution valve, a first open condition, wherein only said first outlet communicates with the inlet of the distribution valve, a second open condition, wherein only the first and second outlets communicate with the inlet of the distribution valve, and a third open condition, wherein all the said first, second and third outlets communicate with said inlet of the distribution valve, and said electronic control unit is configured to receive a signal indicative of a turning-off order of the engine and for consequently controlling a switching of the electronically-controlled distribution valve into its closed condition, in such a way that when hot coolant leaves the engine, it is conveyed into the said expansion vessel, and said pump is driven by the engine and in that said electronic control unit is configured to enable turning off of the engine only after having detected a filling of the expansion vessel with the hot coolant leaving the engine.

7. The cooling system according to claim 6, wherein said pump is electrically-driven, and switching of the distribution valve into the closed condition to obtain a filling of the expansion vessel with the hot coolant, is controlled after the engine is turned off.

8. The cooling system according to claim 1, wherein two temperature sensors are provided in the said second duct, arranged upstream and downstream of the expansion vessel, respectively, and wherein the electronic control unit is arranged to receive outgoing signals from said temperature sensors.

* * * * *